United States Patent [19]

Cottrell

[11] 3,989,201

[45] Nov. 2, 1976

[54] FILM DRIVING MECHANISM FOR HIGH INERTIA STORAGE ROLLS

[75] Inventor: Edward D. Cottrell, Cattaraugus, N.Y.

[73] Assignee: Champion International Corporation, Stamford, Conn.

[22] Filed: Nov. 22, 1974

[21] Appl. No.: 526,264

[52] U.S. Cl. ..... 242/55; 242/65; 242/75.1; 242/75.47; 242/75.5

[51] Int. Cl.[2] ..... B65H 23/08; B65H 23/18

[58] Field of Search ..... 242/55, 75–75.53, 242/65, 67.3, 67.4

[56] References Cited

UNITED STATES PATENTS

| | | | |
|---|---|---|---|
| 1,672,320 | 6/1928 | James | 242/75.41 |
| 1,853,292 | 4/1932 | Wood | 242/75.41 |
| 1,973,363 | 11/1934 | Wood | 242/75 |
| 3,348,787 | 10/1967 | Giles | 242/75.5 |

*Primary Examiner*—Stanley N. Gilreath
*Assistant Examiner*—John M. Jillions
*Attorney, Agent, or Firm*—Evelyn M. Sommer; Anthony J. Casella

[57] ABSTRACT

A mechanical means for unwinding paper sheet, plastic film or other thin films from heavy storage rolls. The device includes a normal unwind pair of squeeze rolls which grip the film on opposite surfaces and propel the film toward a use area. A friction roll is positioned on the periphery of the storage roll but normally runs free and is not coupled to a power means. When the mechanism is accelerating, as in a starting operation, power is applied to the friction roll to aid in its speed-up. When the mechanism is decelerating, as in a stopping operation, power is applied to the friction roll to aid as a brake. Auxiliary pressure means may be provided to increase the contact pressure between the friction roll and the storage roll to prevent slipping.

9 Claims, 3 Drawing Figures

FILM DRIVING MECHANISM FOR HIGH INERTIA STORAGE ROLLS

BACKGROUND OF THE INVENTION

Many films and sheets, such as paper and plastic, are supplied in large heavy rolls having considerable inertia. If there is no auxiliary aiding means, the unwind operation must be started quite slowly, otherwise the film will be ruptured. Also, after normal operating speed of an unwind operation is underway, the high inertia of the storage roll tends to keep it turning and a fast stop is almost impossible without unwinding a large quantity of unwanted film. Many attempts have been made to control the movements of the storage roll by using complicated control means, either mechanical or electrical, but these means are expensive, difficult to maintain, and require precise adjustment of parts.

The present invention uses an array of simple components and avoids complication of construction. There are no control circuits as such and the mechanical units are simple, requiring a mechanic of only modest ability for service and maintenance. In the event of a component failure, replacement or repair can be made by replacing individual parts, easily and quickly.

One of the features of the present invention is the automatic nature of the aid components, helping to accelerate when starting up and braking when slowing to a stop.

SUMMARY

The film driving mechanism for unwinding a storage roll comprises, a normal unwind mechanism including a pair of squeeze rolls coupled to a power source for drawing the film from the storage roll at a constant speed. A friction roll is positioned on the film storage roll and idles when the mechanism is running at normal speed. A first auxiliary drive means is used to aid the normal unwind mechanism when the driving means is increased in speed. This drive means includes a clutch overdrive coupled between the friction roll and a power source. The power source is adjusted to drive the clutch at less than normal speed.

A second auxiliary drive means aids the normal unwind mechanism when the driving means is stopped or greatly reduced in speed. This second means also includes an overdrive clutch coupled between the friction roll and a power source which drives part of the clutch faster than the normal speed.

In order to accommodate larger size paper supply rolls, the film drive mechanism of the subject invention may be provided with auxiliary pressure applying means for increasing the contact pressure between the friction roll and the storage roll to prevent slippage.

Additional details of the invention will be disclosed in the following description, taken in connection with the accompanying drawing.

DESCRIPTION OF THE PREFERRED EMBODIMENT

Figure 1:
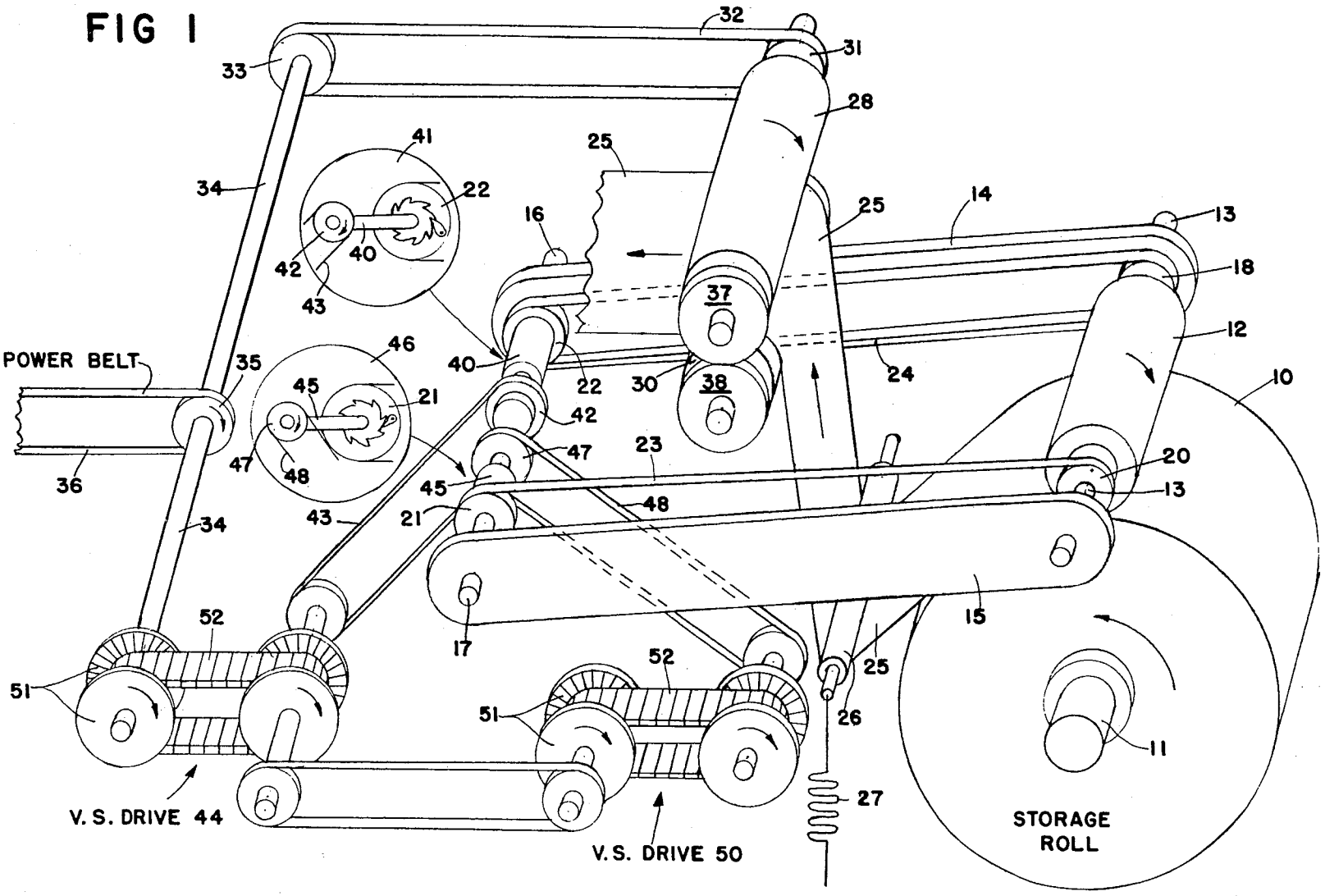
FIG. 1 is a diagrammatic view of the principal components of the invention. Certain base supports, journals, and bearings have been omitted for the sake of clarity.

Referring now to the FIG. 1, the unwinding device is built around a large storage roll 10 of film or paper. The roll 10 is supported on a horizontal shaft 11, the ends of which turn in bearings (not shown). At the top of roll 10, a friction roller 12 is positioned. Roller 12 is cylindrical in shape and is provided with a friction surface, for example; a nonmarking rubber. The roller turns in ball bearings so that it normally turns freely around a fixed shaft 13. The shaft 13 is secured to link members 14 and 15, pivoted on shafts 16 and 17. Shafts 16 and 17, while not necessarily connected in alignment with each other, form a pivot about which the friction roller shaft 13 may rock as the size of the storage roll is reduced. The friction roll 12 has its ends secured to two pulleys 18 and 20 and these pulleys (preferably sprocket wheels) are coupled to over-running clutch wheels 21 and 22 by belts 23, 24. Both clutches, to be described in greater detail later, have overrunning portions which permit the friction roller 12 to turn freely on its shaft 13 during the normal operation of the mechanism.

A film 25 of paper or plastic is threaded from roll 10, under friction roll 12, then under a take-up roll 26 held in resilient stress by spring 27, then through the two squeeze rolls 28 and 30 which normally furnish all the power necessary to unwind the film. Roll 28 is secured to pulley 31 which is turned by belt 32, pulley 33, shaft 34, pulley 35, and a power belt 36. The power belt 36 is connected to and synchronized with the film converting equipment designed to use film 25. While belts can ordinarily be used, it is preferred to have all the pulleys replaced by sprocket wheels and the wheels coupled by chain belts. The lower squeeze roller 30 may be an idler roll but it is best to turn it by means of friction or geared couplings 37, 38 as shown.

The first auxiliary drive means includes an overrunning clutch having a pawl member 22 and a driver shell 40. A diagrammatic view of this clutch is shown in circle 41 where the pawl is secured to wheel 22 and the driver shell is indicated by shaft 40. Shaft 40 is turned by wheel 42 and by belt 43. It is evident from this showing that if the ratchet wheel 22 is run faster than wheel 42, the pawl will disengage and wheel 22 will be free running. Belt 43 is powered by shaft 34 coupled through a variable speed drive 44. The drive shown indicates an infinitely variable speed transmission of the type manufactured by the Link-Belt Division of the FMC Corporation and available commercially. However, other types of drives can be used, the only requirement being that for normal use, pulley 42 turns slower than wheel 22 by about one-half of one percent. This insures that wheel 22 and its ratchet are over driven.

In like manner, the second auxiliary drive means includes a clutch having a pawl member 21 and a driver shell 45. A diagrammatic view of this clutch is shown in circle 46 where the pawl is secured to wheel 21 and the driver shell is indicated by shaft 45. Shaft 45 is turned by wheel 47 and by belt 48. It should be noted that both the ratchet pawl and the ratchet wheel have their directions reversed as compared to the above described clutch 22, 40.

Belt 48 is driven by another infinitely variable speed transmission 50, both transmissions being coupled together and both receiving their mechanical power from shaft 34 and the power belt 36. The variable speed drive 50 is adjusted so that wheel 47 and the ratchet wheel turn slightly faster than the pawl wheel 21 so that, under normal speed of operation, the pawl overruns the shaft 45.

When this feeding mechanism is in normal operation, all the power for drawing the film from the storage roll 10 is applied by the squeeze rolls 28, 30. Both clutches are overrunning, their pawl carrying wheels 21, 22 being turned by belts 23, 24 and the friction roller 12.

When the mechanism is first started, or the speed of operation is increased for any reason, the inertia of the storage roll 10 retards the speed increase, causing idler roll 26 to move up and lowering the speed of the friction roll 12. This action stops the overrunning action of the first auxiliary drive means, the ratchet pawl falls into engagement with the ratchet wheel and power is applied to the friction roller 12, turning it to speed up the storage roll 10. When the speeds of all the components approach normal, the shaft 40 again moves slower than the pawl wheel 22 and the two are disengaged.

When the mechanism is stopped, or otherwise greatly reduced in speed, the inertia of the storage roll 10 causes it to retain its speed of rotation, lowering idler roll 26 and providing a speed of rotation to the friction roller 12 that is higher than its associated components. This higher speed causes pawl wheel 21 to engage wheel 47 and a braking action is transmitted through the variable speed transmission drive 50 to brake friction roller 12 and slow down the storage roll 10. The overrunning clutches in circles 41 and 46 are shown as ratchet wheel-pawl devices. Other types of overrunning clutches can be used, such as the type that employs pinch cylinders between a circular rim and a wedge shaped power wheel. The two variable speed drives 44, 50 are well known. Each employs a double pair of cone wheels 51 and an articulated belt 52 composed of transverse slidable plates which adapts their position to cut out channels on the cone surfaces and provide mechanical traction. This type of variable speed transmission is of particular value in this application since the speed can be adjusted quite accurately to a one-half of one percent value above or below the normal speed.

Figure 2:
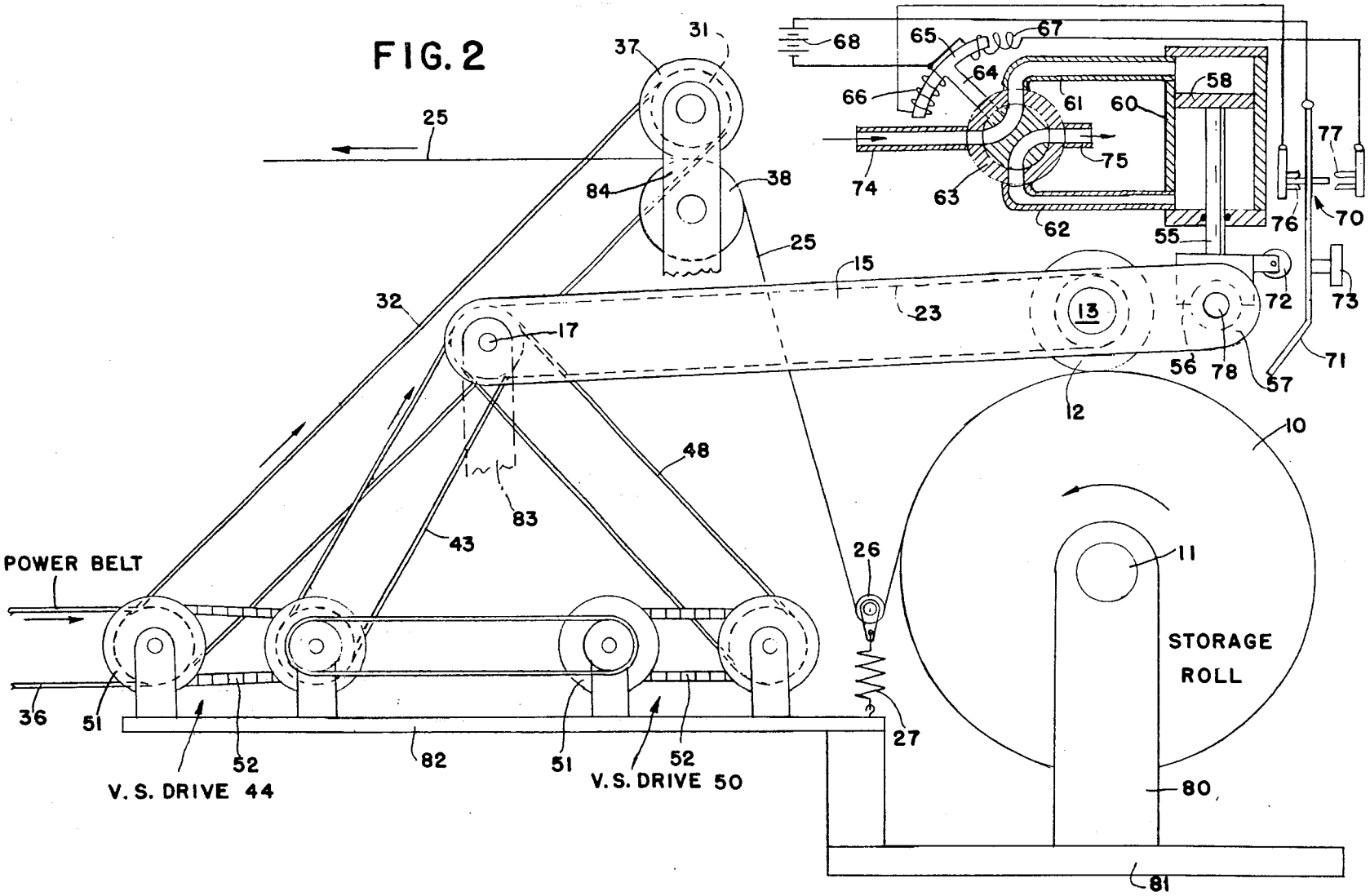
FIG. 2 is a side view of an alternate form of the invention, showing a pressure means for avoiding slipping when the roll is heavy.

Referring now to FIG. 2, the film driving mechanism is shown in side view with a pressure applicator means for applying pressure to the friction roller 12 when very large paper rolls are used. Paper suppliers are now delivering rolls having a maximum diameter of 52 inches and weighing about 1000 pounds. In order to handle such large weights it has been found necessary to supply additional pressure on both ends of shaft 13 in order to prevent slipping. This is especially true when the roll 13 is started or stopped.

Additional downward pressure can be applied by the pneumatic device shown in FIG. 2 where a piston rod 55 is secured to a yoke 56 that engages an extension 57 of link members 14 and 15. Rod 55 is also secured to piston 58 in cylinder 60 having an inlet conduit 61 and an outlet conduit 62. The conduits are connected to a double valve 63 so that the pressure inlet and drain outlet conduits may be reversed in their function and move the piston up instead of down. The valve 63 is operated by a shaft 64 connected to a curved double solenoid core 65, surrounded by solenoid windings 66 and 67. Electric power is supplied by a battery 68 or other convenient source of current and the selection of the solenoid winding is controlled by a double pole switch 70. The switch arm 71 is provided with an extension, acting as a cam follower, for operating the switch whenever the yoke 56 and its cam roller 72 are lowered by the storage roll 10 as its radius is decreased due to the unwinding of its contents. Switch arm 71 is also provided with a button 73 for manual operation to change the direction of motion of the piston 58 when a new roll of paper is to be installed.

The operation of this pressure applicator is as follows: It is assumed at the start that compressed air, or fluid under pressure, is not turned on in the pressure conduit 74 and that piston 58 and yoke 56 along with roller 12 are raised to permit the installation of the roll 10 of paper. As soon as the roll is in place, roller 12 is lowered to the surface of roll 10, manually operated button 73 is depressed, and pressure is applied to conduit 74. This action sends pressurized air through the valve 63, as shown in FIG. 2, and pushes piston 58 down, discharging air from the bottom of the piston through conduit 62, the valve, and drain pipe 75. This action applies mechanical pressure to link members 14 and 15 and increases the pressure of roller 12 on the roll of paper 10 thereby reducing slippage.

When the yoke 56 and its cam roller 72 have been lowered a short distance by the unwinding action of roll 10, the roller 72 makes contact with arm 71 and moves switch 70 to break contacts 76 and close contacts 77. This action removes the current from winding 66 and sends current through winding 65, operating valve 63 and sending pressurized fluid from conduit 74 to conduit 62 and also connecting conduit 61 to drain pipe 75. The fluid pressure now is applied to the underside of piston 58 and the piston plus the yoke 56 are raised to an upper limit position, removing the additional pressure from roll 10 and permitting it to act in its normal manner.

When a new storage roll 10 is installed, link members 14 and 15 are raised, the roll is put in place and the additional pressure from piston 58 is added by manually moving button 73 to the left. This changes the valve to the position shown in FIG. 2 and pressure is applied to roller 12. The link members 14 and 15 are joined by a bar 78 so that a single pressure piston 58 and valve 63 can depress both link members by applying yoke 56 to the center of rod 78. Two pistons and two yokes 56 may be used, each applied directly to the ends of the link members. In any case, only one valve 63 is necessary.

FIG. 2 shows the storage roll 10 mounted on supports 80, secured to a base 81. An additional base 82 supports the variable speed drives 44 and 50 and the vertical supporting rods 83 and 84 are also secured to base 82. The valve 63 and the piston cylinder are supported on means (not shown) secured to base 81.

Figure 3:
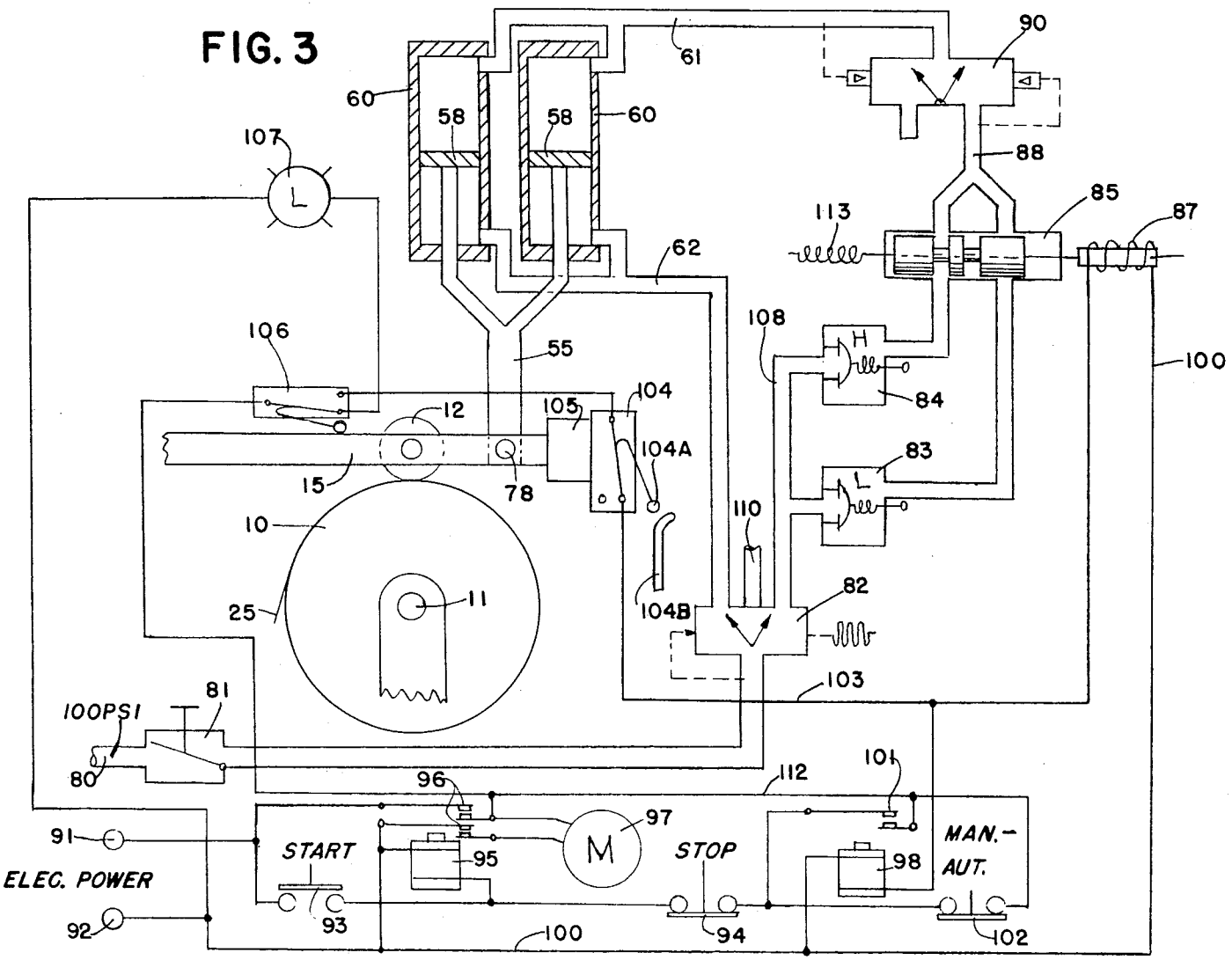
FIG. 3 is a diagrammatic showing of an alternate pneumatic means for applying pressure to the friction roll on the storage roll.

The arrangement of controls shown in FIG. 3 is an alternate control means which moves the link member up to permit loading a new roll of paper and, when the roll 10 starts to rotate, provides a high or low pressure to the friction roller 12, depending upon requirements. The alternate control means includes two pistons 58 moving in cylinders 60. One piston and cylinder is positioned at each end of the friction roller and each cylinder 60 has its upper end connected to a common conduit 61 with its lower end connected to a similar common conduit 62. Power for operating the pistons is derived from a source of fluid pressure (either liquid or gas) applied to conduit 80 and first controlled by an input valve 81, manually operated, which sends high pressure fluid to the main operating valve 82. Valve 82 is connected, in one position, to two pressure reducing valves 83 and 84 for applying a high pressure or a low pressure to the pistons 58 and the friction roller 12. These reducing valves may be the well known diaphragm valves with adjustable spring means to vary the output pressure. The output of the pressure reducing valves 83, 84 is applied to a switching valve 85 which connects either the high or low pressure to the piston cylinders 60. The operation of the switching valve is by a solenoid core 86 whose winding 87 is connected to an electric control circuit, to be described presently. The output of the switching valve 85 is connected to a conduit 88 and quick exhaust valve 90, operated by its input-output pressures to permit a quick exhaust from the cylinders 60 through conduit 61 when the pistons 58 and the friction roller 12 are raised to permit a new roll of paper 10 to be installed.

The electrical control circuit receives its power from two terminals 91, 92 which are to be connected to a source of direct current power. A normally open start switch 93 is connected in series with one of the terminals 91 and a normally closed stop switch 94. A motor relay includes a winding 95 connected between terminal 92 and the conductor which connects the start and stop switches. The relay contacts 96 are respectively connected between terminals 91, 92 and a motor 97 which runs all the belts by means of power belt 36 (see FIG. 2). A second relay includes a winding 98 connected between terminal 92 (and supply conductor 100) and one side of the solenoid winding 87. The relay contacts 101 on relay winding 98 are connected around a third manually operated switch 102 which is normally closed. The rely winding 98 is also connected over conductor 103 to a microswitch 104, secured to the end of link 15 whose sensing arm 104A is mounted so that it is operated by a plate 104B secured to the frame 81.

The end of link 15 may be provided with a weight box 105 which assists in adding pressure to the friction wheel 12. A second microswitch 106 is mounted above the link 15 and is of the single throw-double pole type. Switch 106 is connected in series between one of the motor contacts 96 and microswitch 104 and is designed to provide switch 104 with current as long as link 15 is above a predetermined height. When link 15 is depressed, indicating a small diameter storage roll 10, the switch 106 is operated and current is sent to an alarm lamp 107 to let the operator know that it is about time to supply another storage roll 10.

The operation of this control device is as follows: At the start, a new roll of paper 10 has been put in place on shaft 11, the pistons 58 and link 15 are both in their upper position. The input valve 81 is manually opened and fluid pressure is applied to the operating valve 82 which shifts pressure to conduit 108 and, at the same time, connects conduit 62 to exhaust port 110 and the fluid under pistons 58 is exhausted to the atmosphere or to some suitable drain. The pressure in conduit 108 sends fluid through the high pressure reducing valve 84, through switching valve 85 and the quick exhaust valve 90, to conduit 69 and the top portions of cylinders 60, moving friction roller down to make contact with the top of the paper roll 10. During this time the roll 10 is at rest since the motor 97 has not been activated.

Valve 90 is the type having sustaining pressure supplied from both conduits 88 and 61 so that a high pressure in conduit 88 moves the valve to the left and holds it there, permitting fluid to flow into the cylinders 60 to exert force on the pistons. When pressure is reduced in conduit 88 and pressure applied to conduit 62, the pistons 58 are forced up, putting pressure in conduit 61 and operating valve 90 to send fluid from the top of cylinders 60 through exhaust port 111. This type of valve is known in the art and its details need not be described here.

The operator now depresses the start switch 93 sending current from terminal 91 through the start switch 93, through winding 95 of the motor relay, and back over conductor 100 to the other terminal 92. This action closes both of the motor contacts 96 and supplies power to the motor 97, turning all the belts and unwinding paper from roll 10. In this start-up period the increase in speed of roll 10 is aided by the power applied to friction roll 12 as described previously. The closing of both contacts 96 provides a locking circuit which retains the motor relay in its activated condition after the start switch is opened. This locking circuit may be traced from terminal 91 through upper contact 96, then over conductor 112 to the "MAN-AUTO" switch 102, stop switch 94, relay winding 95, and back to terminal 92. It is obvious from the trace of this locking circuit that the relay will be normalized and the motor stopped when the stop switch is opened.

As the paper starts to move from the roll 10, there is a sufficient time lag before the microswitches function to allow the roll of paper to come up to full speed, therefore, when both microswitches have been actuated, solenoid valve 85 is energized thus shifting the fluid supply and generating the pressure on the friction roll 12 to the low pressure regulating valve 83. At this point, the excess pressure fluid is bled off and the low pressure operating mode established.

After the startup mode, the operator may manually change the switching arrangement by opening the MAN-AUTO switch 102. This switch is connected across contacts 101 on relay winding 98 which has been actuated by the current through the two microswitches 106 and 104, therefore the opening of switch 102 during the running time changes nothing. Relay 98, 101 serves as an automatic safety switch when switch 102 is open since operation of either one of the microswitches 106, 104 will then stop the motor 97. If the machine stops either automatically or through action by the operator, valve 85 immediately is shifted to the position where the higher pressure is applied from valve 84 to the pistons 58, thus preventing serious overrun of the paper from roll 10. The roll 10 is brought to a stop in synchronism with the other moving elements of the machine. Valve 85 is normalized by mechanical spring 113 when current is removed from solenoid winding 87.

The embodiments of the invention in which an exclusive property or privilege is claimed are defined as follows:

1. A film driving mechanism for unwinding a storage roll having high inertia comprising:

a. a power source including a main drive means;

b. a normal unwind mechanism including a pair of squeeze rolls coupled to said main drive means for drawing the film from the storage roll at a substantially constant speed;

c. a friction roll coupled to said main drive means and pressed into contact with the storage roll, which friction roll normally runs at the speed of said normal unwind mechanism;

d. a first auxiliary drive means coupled to said main drive means and operative to reduce the speed of the friction roll in response to said friction roll increasing its speed beyond a pre-determined acceleration value, said first auxilliary drive means including a first clutch overdrive coupled between said friction roll and the main drive means of the power source, with said first clutch overdrive being operative to reduce the drive speed of the friction roll by less than 5 percent of the normal speed; and e. a second auxiliary drive means coupled to said main drive means and operative to increase the speed of the friction roll in response to said friction roll decreasing its speed beyond a pre-determined deceleration value, said second auxiliary drive means including a second clutch overdrive coupled between said friction roll and the main drive means of the power source, with said second clutch overdrive being operative to increase the speed of the friction roll by less than 5 percent of the normal speed.

2. A film driving mechanism as claimed in claim 1 wherein said first and second clutch overdrive means each include a ratchet wheel driven by the main drive of the power source, and an associated pawl driven by the friction roll.

3. A film driving mechanism as claimed in claim 1 wherein said friction roll rides on the periphery of the storage roll.

4. A film driving mechanism as claimed in claim 1 wherein said squeeze rolls are cylinders having the same diameters.

5. A film driving mechanism for unwinding a storage roll having high inertia comprising:

a. a power source including a main drive means;

b. a normal unwind mechanism including a pair of squeeze rolls coupled to said main drive means for drawing the film from the storage roll at a substantially constant speed;

c. a friction roll coupled to said main drive means and pressed into contact with the storage roll, which friction roll normally runs at the speed of said normal unwind mechanism;

d. a first auxiliary drive means coupled to said main drive means and operative to reduce the speed of the friction roll in response to said friction roll increasing its speed beyond a pre-determined acceleration value, said first auxilliary drive means including a first clutch overdrive coupled between said friction roll and the main drive means of the power source, with said first clutch overdrive being operative to reduce the drive speed of the friction roll by less than 5 percent of the normal speed;

e. a second auxiliary drive means coupled to said main drive means and operative to increase the speed of the friction roll in response to said friction roll decreasing its speed beyond a pre-determined deceleration value, said second auxiliary drive means including a second clutch overdrive coupled between said friction roll and the main drive means of the power source, with said second clutch overdrive being operative to increase the speed of the friction roll by less than 5 percent of the normal speed; and f. pressure means operatively associated with said friction roll for increasing the contact pressure of the friction roll with the storage roll to prevent slipping.

6. A film driving mechanism as claimed in claim 5 wherein said pressure means includes a piston movable within a cylinder and means for applying pressurized fluid to the piston.

7. A film driving mechanism as claimed in claim 5 wherein a sensing means is secured to the pressure means for disabling the latter means whenever the friction roller has moved toward the center of the storage roll a predetermined amount.

8. A film driving mechanism as claimed in claim 7 wherein said pressure means is controlled by a solenoid operated valve and a solenoid winding connected to said sensing means for operating the valve whenever the sensing means is operated.

9. A film driving mechanism as claimed in claim 8 wherein said solenoid operated valve is connected to a high pressure source and a low pressure source and switches the high pressure to the piston in its cylinder when the sensing means senses a break in the film.

* * * * *